US005216780A

United States Patent [19]

Lutzke et al.

[11] Patent Number: 5,216,780

[45] Date of Patent: Jun. 8, 1993

[54] HANDGRIP FOR LINK CHAIN

[76] Inventors: David E. Lutzke, 18 Maple View Ct., Madison, Wis. 53719; Ferdinand F. Salzmann, 222 Randolph Dr., Madison, Wis. 53517

[21] Appl. No.: 838,318

[22] Filed: Feb. 20, 1992

[51] Int. Cl.[5] ..... A47B 95/02

[52] U.S. Cl. ..... 16/111 R; 16/114 R; 16/DIG. 12; 472/118

[58] Field of Search ..... 16/110 R, 111 R, 114 B, 16/114 R, DIG. 24, 122, DIG. 12, DIG. 15, DIG. 28, DIG. 41; 24/115 R, 116 A, 116 R; 472/118, 121-123; 59/93, 78, 78.1; 297/273; 190/115-117; 5/466; 296/71

[56] References Cited

U.S. PATENT DOCUMENTS 1,340,904 5/1920 Medart ..... 472/118
2,398,436 4/1946 Mason ..... 16/114 B
3,298,738 1/1967 Shalhoob ..... 472/118
4,071,063 1/1978 Russell ..... 16/114 R
4,791,702 12/1988 McVey ..... 16/DIG. 15

FOREIGN PATENT DOCUMENTS 969517 12/1950 France ..... 190/115

*Primary Examiner*—Lowell A. Larson
*Assistant Examiner*—Donald M. Gurley
*Attorney, Agent, or Firm*—Keith Schoff

[57] ABSTRACT

A tubular handgrip for attaching to link chain as a sleeve is made by joining a pair of identical semi-circular components around a chain. The mated components each has a post portion which extends transversely through a link in the chain to prevent the grip from slipping along the chain with the two components being mutually adjustable lengthwise to enable the spacing between post portions to be varied as necessary to accept any chain-link length.

8 Claims, 3 Drawing Sheets

HANDGRIP FOR LINK CHAIN

FIELD OF INVENTION

Link chain is used in applications where manual gripping of the chain is required, as for example, in using a child's swing set. Handholds improve the ease with which chain can be manipulated.

PRIOR ART

Chain grips heretofore have been non-adjustable for use with chain of any link length, and have also been unsuitable for shielding a user's hand from injury caused by pinching of flesh in any gap created by spreading and separation of grip components when stressed by chain being bent within a grip, as by pumping of swing chain.

SUMMARY OF THE DISCLOSURE

A chain grip is disclosed which is universally adaptable for use with chain of any link length. The grip comprises two components which are preferably of identical, semi-tubular configuration. The configuration is preferably such that the components can be arranged to form a sleeve around a length of chain with mating edges disposed to overlap or interleaf and be slidable lengthwise with respect to one another. Preferably, a transversely extending post portion projects from each component for passing through a link in a chain and being secured to the opposite component by a screw being inserted through a countersunk slot in the wall of the opposite component and being opearably driven through the end face of the post portion. The distance between the post portions can be adjusted to accept any length of chain link by shifting the components longitudinally with respect to each other thereby to relocate the screws within the slots and, in consequence, displace the end faces of the components from alignment.

DESCRIPTION OF THE INVENTION

Figure 1:
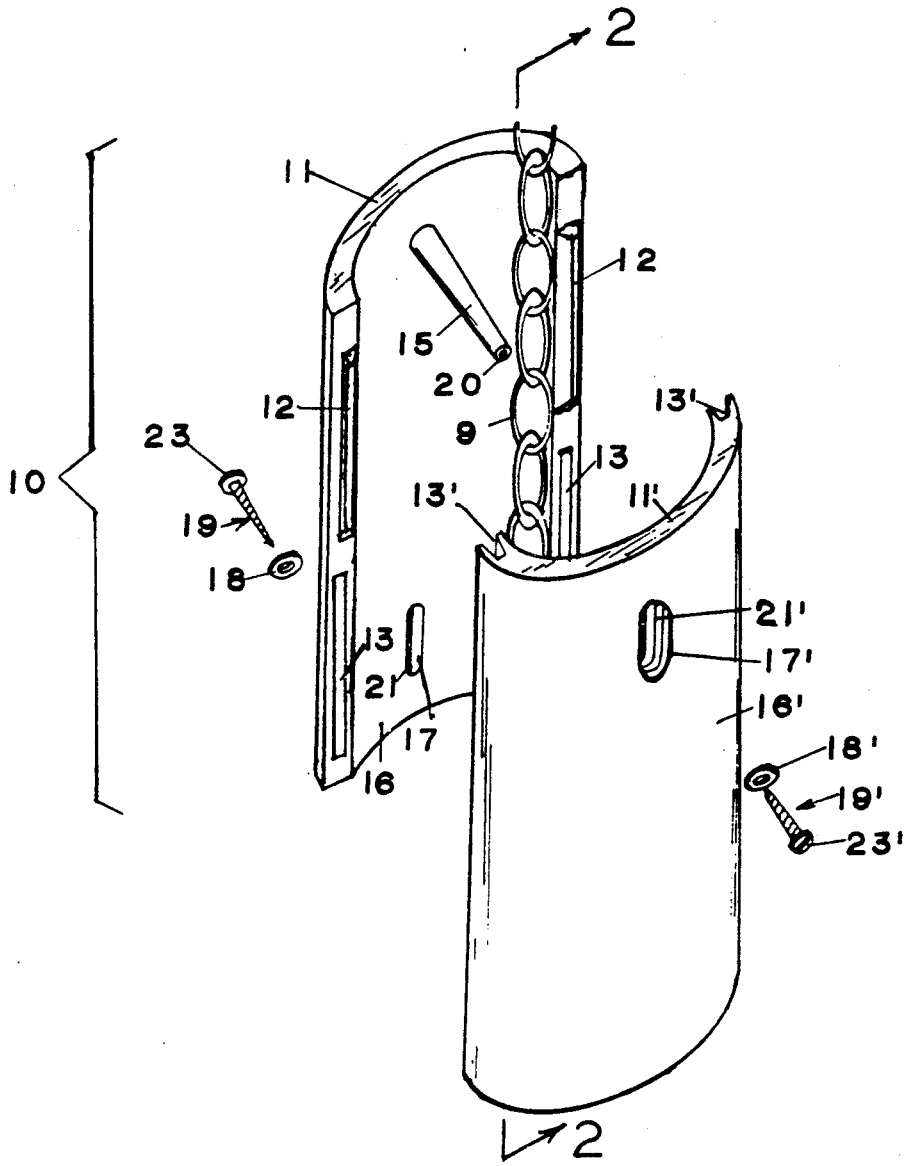
FIG. 1 is an exploded perspective view of two components of a grip of this invention shown in relation to a chain which they encircle when operably connected.
Figure 2:
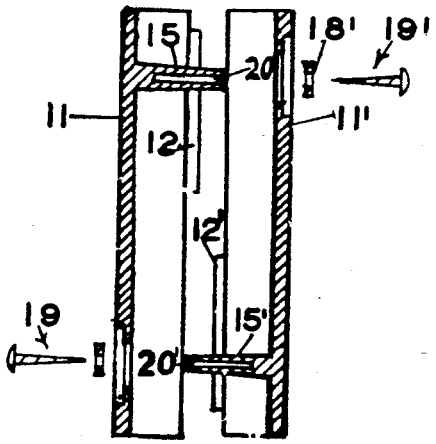
FIG. 2 is an elevational view in cross-section of the components of FIG. 1.

In FIGS. 1 and 2 hand grip 10 is shown comprising two identical semi-tubular components 11, 11'. The components are shown mutually inverted with abutting edges configured with tenons 12, 12' (FIG. 2) disposed to be received in mortises 13, 13' (FIG. 1). Mortises 13, 13' are longer than tenons 12, 12' to enable the components 11, 11' to be adjusted longitudinally with respect to each other so that the end faces of the grips may be displaced in alignment without disposition of interleaf-ing tenons 12, 12' in mortises 13, 13', being disturbed.

Post portions 15, 15' of components 11, 11' are shown to perpendicularly project from wall portions 16, 16' and be conically tapered to provide a draft angle for removal from injection molding dies. Openings 20, 20' are provided in the end faces of post portions 15, 15' for receiving screw threaded means 19, 19' operably therein.

Wall portions 16, 16' of components 11, 11' are provided with countersunk, slot configured openings 17, 17'. Shoulders 21, 21' of the countersinking provide a surface upon which washers 18, 18' rest so that the heads 23, 23' of screw threaded means 19, 19' will be recessed below the extended outer surface of sleeve configured grip 10 when the components 11, 11' are operably joined by screw threaded means 19, 19' being drawn tightly into openings 20, 20' of post portions 15, 15'.

Components 11, 11' are preferably made from pliable thermoplastic resin, such as polyethylene or polypropylene, although any other suitable material may be used. A preferred method of manufacture is injection molding.

Openings 17, 17' in wall portions 16, 16' or components 11, 11' are elongated in the axial direction of grip 10. Elongation of openings 17, 17' enables the components 11, 11' to adjusted lengthwise with respect to one another with the result that the distance separating post portions 15, 15' can be varied as necessary to accommodate chain links of any length. Thus, if at a given setting of separation distance between post portions 15, 15', interference between a link and one of the post portions occurs when engaging components 11, 11' with chain to install grip 10 on the chain, the alignment of the ends of components 11, 11' can be staggered until the obstruction preventing passage of a post portion through a chain link is avoided and the components 11, 11' can be operably engaged and joined with the end extremities of the components remaining in staggered disposition. The extent of such staggered alignment is dependent upon the lengths of slot in opening's 17, 17'. In a preferred embodiment, the length of slot in openings 17, 17' is great enough so that the clear distance between the extreme positions of a post portion 15, 15' while it is operably engaged by a screw threaded means 19, 19' disposed in an opening 17, 17' is at least equal the length of any obstruction, measured in an axial direction of the chain, which may be encountered by a post portion 15, 15' in being inserted through the chain. The minimum length of such clear distance would be twice the thickness of a chain link and the maximum distance would be the distance measured axially of a chain that is occupied by bent-wire closure in the case of wire chain or other coupling of chain which is not composed of forged or welded links such as is crane or hoisting chain.

For use of a chain grip on a child's swing set, for example, openings 17, 17' might be approximately one inch in length and 0.2 inch in width, with mortises 13, 13' being approximately 0.1 inch in depth, and handle components 11, 11' each being eight inches in length. Grip 10 might have an outside diameter of one and one-eigth inches for use in such an application, and would be proportionately larger for use with heavier chain.

Figure 3:
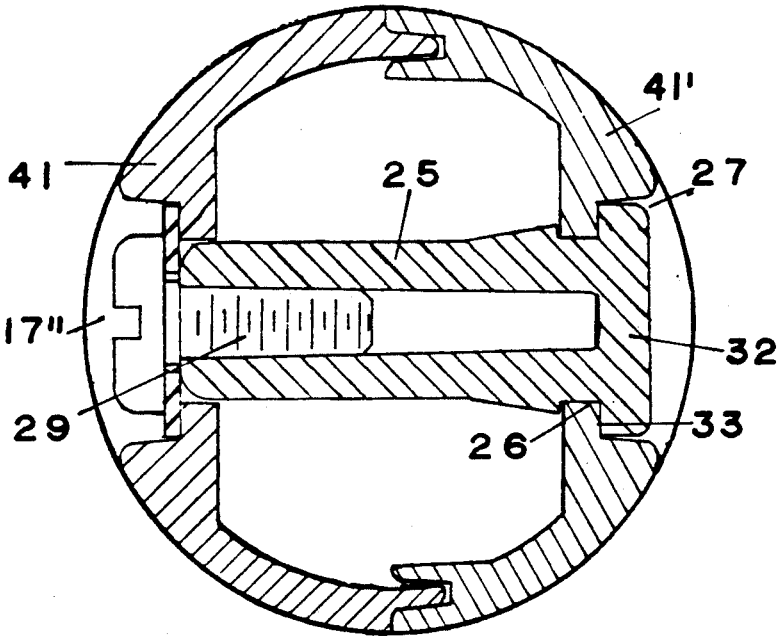
FIG. 3 is an end elevational view of another embodiment.

In FIG. 3, another, non-preferred embodiment of the invention is shown in which post portions 15, 15' of FIGS. 1 and 2 are replaced by plug members 25 which are disposed to be inserted in added slot configured openings 27 disposed in identically configured grip components 41, 41' with head 32 portions resting on shoulders 33 of countersunk openings 27. Plug members 25 are hollow for operably receiving the threaded stem of screws 29. In the embodiment of FIG. 3, grip components 41, 41' can be of any desired length, and any desired number of openings 27 can be provided in each grip component 41, 41' with accompanying plug members 25, and further, the end faces of grip components 41, 41' may be aligned in all installations. The embodiment of FIG. 3 is not preferred because a greater number of parts, that is, the additional plug members 25, is required than for the embodiment of FIGS. 1 and 2. To reduce the possibility that plug members might be separated and lost prior to assembly and installation of a grip, annular recess 26 is provided immediately beneath head portion 32 of plug member 25, dimensioned to provide snap-in assembly in opening 27. Plug members 25 may slide longitudinally in openings 27 in operable manner, but may be disengaged from the openings only by forcible deformation of the plastomeric material from which grip 41, 41' components are preferably made. Openings 27 in the embodiment of FIG. 3 are preferably identical to openings 17'' in which screws 29 are seated, with both openings 27 and 17'' being proportionally identical to openings 17, 17' of FIGS. 1 and 2.

Figure 4:
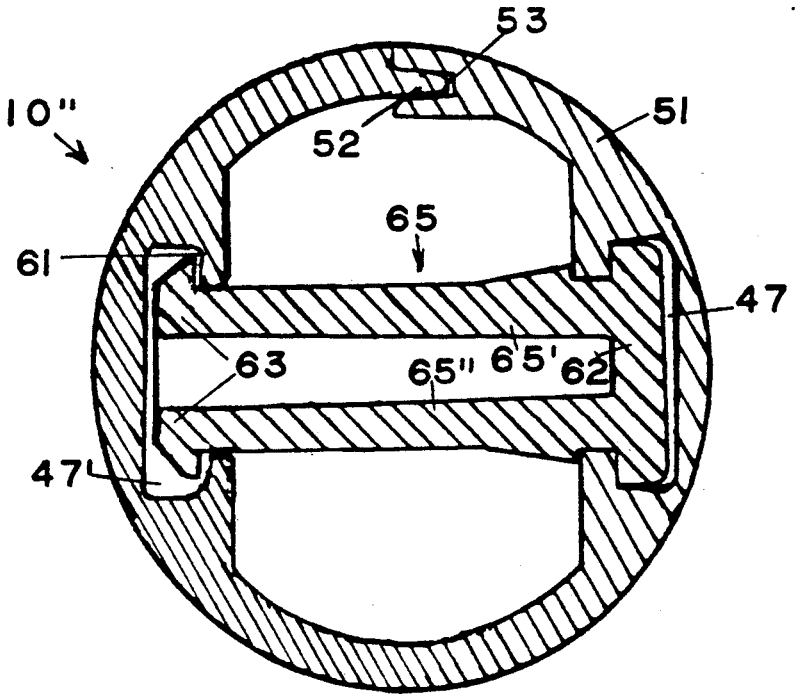
FIG. 4 is a cross-sectional end elevation of another embodiment.

In FIG. 4 grip 10'' is illustrated as a further embodiment of the invention in which a single component, surround 51, constitutes the entire gripping surface. Mating edge portions of surround 51 are configured, one as tenon 52 and the other as mortise 53, to run the full length of the grip. Similarly, channels 47, 47' in the wall of surround 51 extend the full length of surround 51, and receive therein, respectively, head portion 62 and resiliently spread foot portion 63 of plug member 65. Multiple plug members 65 are preferably provided in each grip 10'', disposed through chain links in the manner of plug member 25 of FIG. 3, with placement of plug members 65 preferably being made close to the end extremities of grip 10'' to enable a person to reach the plug member either manually or by use of a long nosed pliers or other tool and squeeze tine portions 65' and 65'' together to displace foot portion 63 from engagement on shoulder 61 of channel 47'. Surround 51 can then be spread to remove tenon 52 from engagement with mortise 53 and enable plug 65 to be removed from engagement in a chain link, and also from engagement in channel 47, if desired, in which it is otherwise tightly gripped when surround 51 is tightly closed with edge portions engaged. The material from which plug member 65 is formed may be the same or similar material to that above disclosed or may be of stiffer material to more forcefully spread tine portions 65', 65'' apart when foot portion 63 of plug member 65 is seated on shoulder 61 of channel 47'. Flexure of surround 51 during spreading will occur principally where the wall thickness of surround 51 is of least dimension at the width extremes of channels 47, 47'. Surround 51 and plug member 65 may both be sectioned from extruded stock, and to any desired length, thereby lending versatility and economy of construction, both in manufacturing procedure and number of parts, to the embodiment. It will be recognized, however, that washers shown in FIGS. 1-3 embodiments may be eliminated from those embodiments, if desired, or plug member 65 be used in FIG. 3.

I claim:

1. A hand grip for link chain comprising a) at least one elongated channel component means having edge portions extending longitudinally of said component means and adapted to be mated in overlapping association to form a sleeve around a chain, b) at least one post portion extending from said component means transversely across said sleeve interiorly thereof, thereby to pass through a link of chain operably disposed within said sleeve, c) at least one elongated opening extending longitudinally of said component means and each opposite to one said post portion, d) at least one fastener means each operably retained in one said elongated opening of one said component means for anchoring said post portion to maintain said sleeve configuration around a chain with said edge portions disposed in in abutting, mating, overlapping association, and with said post portion disposed through a link of chain to render said grip non-displacable along a length of chain.

2. The hand grip of claim 1 wherein each said post portion has means detachably connecting said post portion to said component means from which it extends.

3. The hand grip of claim 1 wherein each said post portion is integral with one said component means from which it extends.

4. The hand grip of claim 1 wherein said post portion is slidably engaged in a slotted opening in said component means from which it extends.

5. The hand grip of claim 1 wherein said fastener means is a screw.

6. The hand grip of claim 1 wherein said opening is of countersunk configuration.

7. The hand grip of claim 1 wherein said fastener means is unitary with said post portion.

8. The hand grip of claim 1 wherein said edge portions of said channel components are of mortise and tenon configurations.

* * * * *